United States Patent [19]

Hamaguchi

[11] Patent Number: 4,490,865

[45] Date of Patent: Jan. 1, 1985

[54] BED APPARATUS WITH URINAL AND AN INTEGRAL DRIVE MECHANISM

[75] Inventor: Yoshiharu Hamaguchi, Tokyo, Japan

[73] Assignee: France Bed Co., Ltd., Tokyo, Japan

[21] Appl. No.: 452,713

[22] Filed: Dec. 23, 1982

[51] Int. Cl.[3] ..... A61G 7/02

[52] U.S. Cl. ..... 5/90; 4/450

[58] Field of Search ..... 5/90, 463; 4/449, 450, 4/465; 269/322; 51/240 R; 173/147, 151

[56] References Cited

U.S. PATENT DOCUMENTS

| | | | |
|---|---|---|---|
| 2,526,879 | 10/1950 | Kizaur | 269/322 |
| 2,605,151 | 7/1952 | Shampaine | 269/322 |
| 2,832,655 | 4/1958 | Adolphson | 269/322 |
| 2,869,614 | 1/1959 | Wamsley | 5/90 |
| 3,333,890 | 8/1967 | Whitwam . | |
| 3,887,951 | 6/1975 | Yates et al. | 5/90 |
| 3,943,583 | 3/1976 | Ishikawa | 5/90 |
| 4,003,704 | 1/1977 | Zurolo et al. | 21/91 |
| 4,030,149 | 6/1977 | Kato | 5/90 |

FOREIGN PATENT DOCUMENTS

| | | | |
|---|---|---|---|
| 56-13464 | 3/1981 | Japan | 5/90 |

*Primary Examiner*—Alexander Grosz

*Assistant Examiner*—Vinh Luong

*Attorney, Agent, or Firm*—Frishauf, Holtz, Goodman & Woodward

[57] ABSTRACT

A bed apparatus with an urinal comprises a bed frame placed with a cushion unit thereon, a cover pivotally provided at an opening formed at the cushion unit, a urinal slidably held along the longitudinal direction of the bed frame and mounted with a guide frame along the sliding direction thereof, and a shielding unit pivotally provided to be urged in a upright direction at the top end of the urinal and normally held in horizontal state underneath the cushion unit. The bed apparatus further comprises a wire provided at both ends with stops engageable with the surface faced with a pair of tong pieces projected from the guide frame or the urinal and with a tension spring extending between both ends of the tong pieces, a driving source for reciprocatingly driving the urinal together with the guide frame through the wire, and a connecting rod connected at one end thereof to the cover and at the other to the guide frame for driving the guide frame via the wire to pivot the cover toward the lower side of the bed frame when the urinal faces the opening, thereby releasing the opening.

12 Claims, 9 Drawing Figures

BED APPARATUS WITH URINAL AND AN INTEGRAL DRIVE MECHANISM

BACKGROUND OF THE INVENTION

The present invention relates to a bed apparatus with a urinal.

There are a number of persons who cannot discharge for themselves since they are confined to beds, such as, for example, hospital patients, old persons and the like. A bed apparatus with urinal has been developed for such persons.

Heretofore, a conventional bed apparatus with a urinal was disclosed in Japanese Patent Publication No. 13,464/81 (published Mar. 28, 1981, I. Okumura et al). More specifically, a slider 6 on which a urinal 16 is mounted is provided beneath a bed A. A threaded shaft 11 is screwed into a female threaded member 15 which is secured to the slider 6. Driving force is applied from a motor 9 to a sprocket wheet 12, which is mounted on the shaft 11, to rotatably drive the shaft 11, thereby reciprocating the urinal 16. When the urinal 16 is brought to the position beneath a front cover 2 and a rear cover 3 pivotally provided in a mat B which is laid on the bed A, the front cover 2 is lowered, and the rear cover 3 is lifted by a pivotal barrier wall 18. This barrier wall 18 is always upwardly biased by the urging force of a spring 21.

However, in the conventional bed apparatus, the threaded member 15 engages the shaft 11 so as to reciprocatingly drive the urinal 16 together with the slider 6 and to transmit the driving force of a motor 9 through a gear train to the shaft 11 so as to rotatably drive the shaft 11. Thus, when the shaft 11 is inclined even slightly in a horizontal or vertical direction, the engaging state of the threaded member 15 with the shaft 11 deteriorates, causing the load on the motor 9 to be increased. Thus, the motor 9 has a shortened service life and the vibration and noise produced therefrom increases. Accordingly, it is desirable to connect the threaded member 15, the shaft 11 and the motor 9 with great precision. However, this necessitates complicated assembly, and further, the threaded shaft 11 and the gears are relatively expensive. These are two principal drawbacks of the conventional apparatus.

SUMMARY OF THE INVENTION

It is an object of the present invention to provide a bed apparatus with a urinal which can facilitate assembly and can also reduce its cost.

In order to achieve this object, a bed apparatus with urinal according to the present invention comprises a bed frame placed with a cushion unit thereon, a cover pivotally provided at an opening formed at the cushion unit, urinal slidably held along the longitudinal direction of the bed frame and mounted with a guide frame along the sliding direction thereof, and a shielding unit pivotally provided to be urged in an upright direction at the top end of the urinal and normally held in the flat state underneath the cushion unit. The bed apparatus further comprises a wire provided at both ends with stops engageable with a surface which bears a pair of tong pieces projecting from the guide frame or the urinal, and with a tension spring extending between both ends of the tong pieces, a driving source for reciprocatingly driving the urinal together with the guide frame via the wire, and a connecting rod connected at one end thereof to the cover and at the other to the guide frame to permit driving of the guide frame by means of the wire to pivot the cover toward the lower side of the bed frame when the urinal faces the opening, thereby releasing the opening.

According to the bed apparatus of the invention as described above, the urinal is driven by the wire together with the guide frame. Accordingly, the bed apparatus can be produced more inexpensively than the conventional bed apparatus which is driven through male threaded shaft and gears, and can also be readily manufactured, as it requires no great assembling accuracy. In addition, the tension spring is interposed between the ends of the wire, and the tension of the wire is not normally applied to the tension spring so that the spring is not elongated. Thus, when the wire is elongated due to long use, the tension spring is contracted that much. Therefore, the bed apparatus has an advantage in that the urinal can be effectively driven via the wire without slippage.

The above and further objects and features of the invention will become more apparent from the following detailed description when the same is read in connection with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

Figure 1:
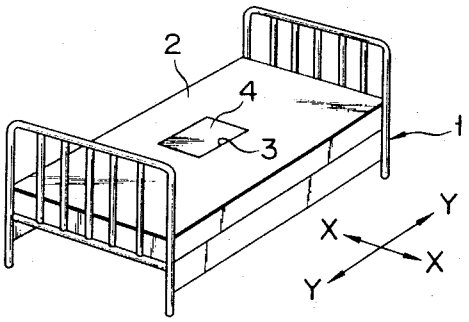
FIG. 1 is a perspective view of a bed apparatus with an urinal according to an embodiment of the invention.
Figure 2:
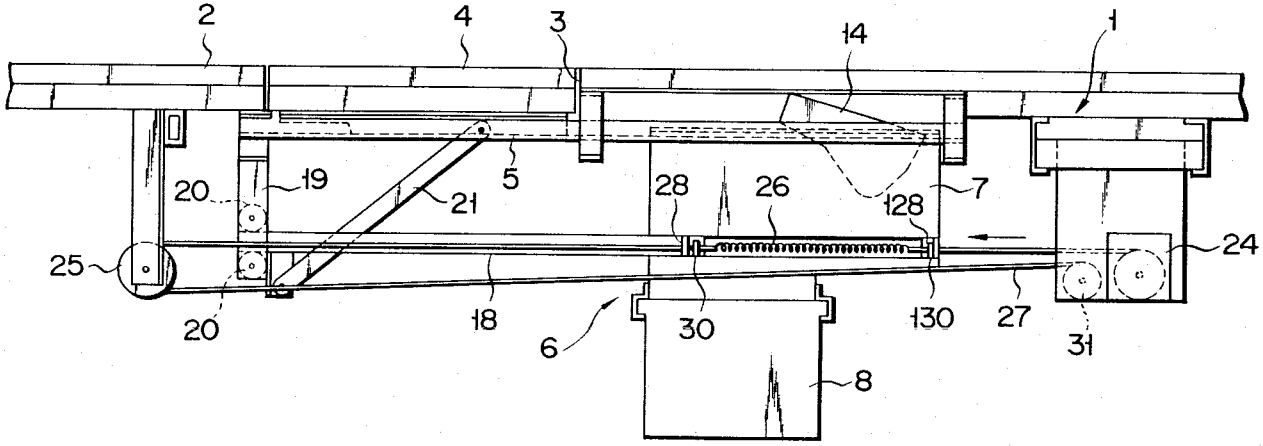
FIG. 2 is a side view of the bed frame.

As shown in FIGS. 1 and 2, a cushion unit 2 is placed on the upper surface of a bed frame 1. An opening 3 is formed substantially at the center of the cushion unit 2. A cover 4 is pivotally secured at one end to the opening 3 of the cushion unit 2 to be turned downward. A pair of rails 5 of cross sectional U-shape are separated laterally (in a direction X—X in FIG. 1) and provided longitudinally (in a direction Y—Y in FIG. 1) on the lower side of the bed frame 1 at the position corresponding to the opening 3 (see FIG. 3). A urinal 6 is slidably held on the rails 5. In other words, this urinal 6 has a rectangular body 7 opened at the upper and lower ends, and a tank 8 of box shape detachably held along the lateral direction of the bed frame 1 at the lower opening of the body 7.

Figure 5:
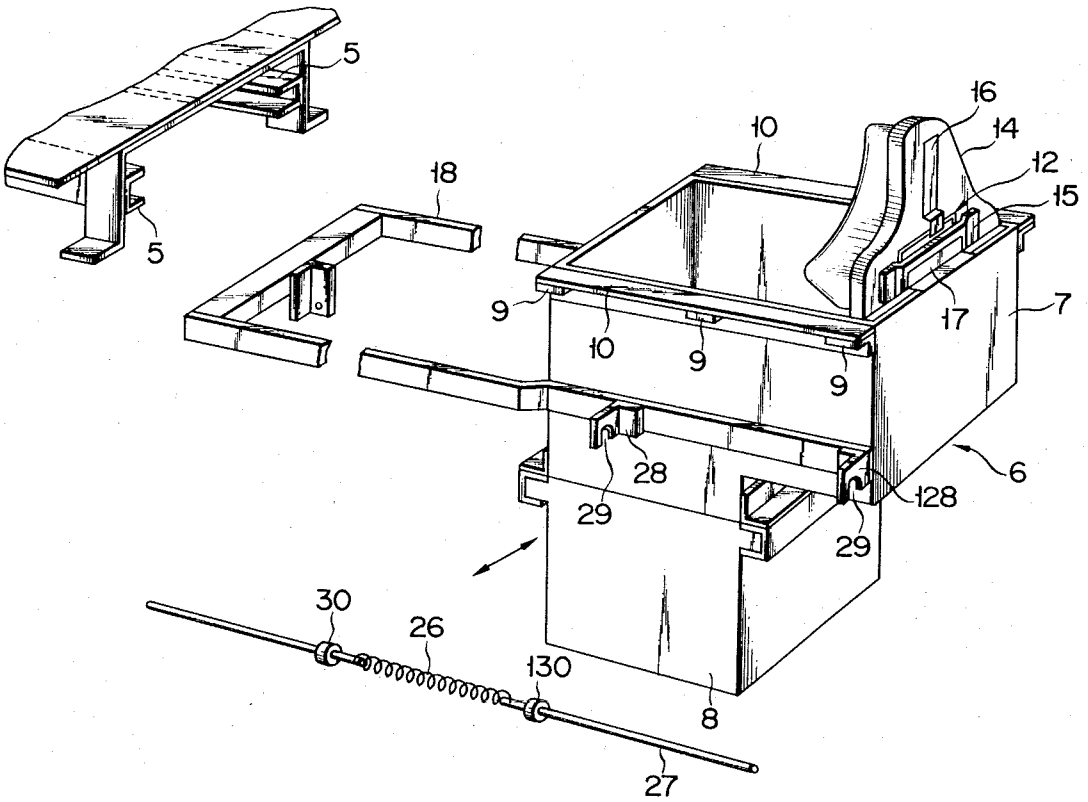
FIG. 5 is a perspective view of the urinal.
Figure 6:
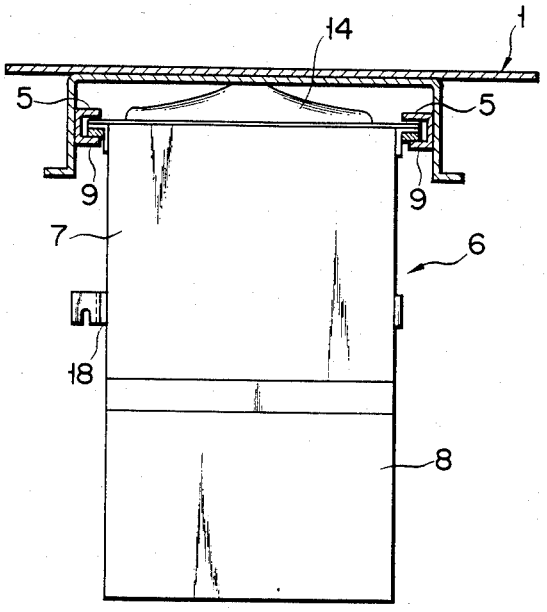
FIG. 6 is a side view of the urinal in the state where the urinal is maintained on rails.

A pair of flanges 10 respectively mounted on three plates 9 having small friction are provided, as shown in FIG. 5, on the lower surface at the upper ends of both sides of the body 7 in the longitudinal direction of the bed frame 1 (in the Y—Y direction of FIG. 2). The flanges 10 are respectively engaged with the rails 5 so that the urinal 6 is slidably held on the bed frame 1 (see FIG. 6).

Figure 7:
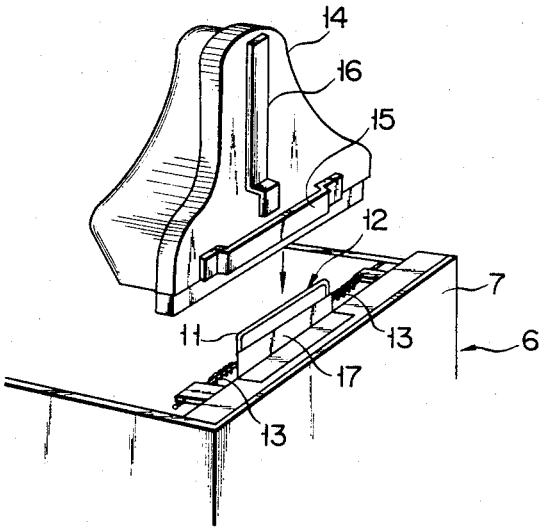
FIG. 7 is a perspective view of a shielding unit detachably provided at the urinal.
Figure 8:
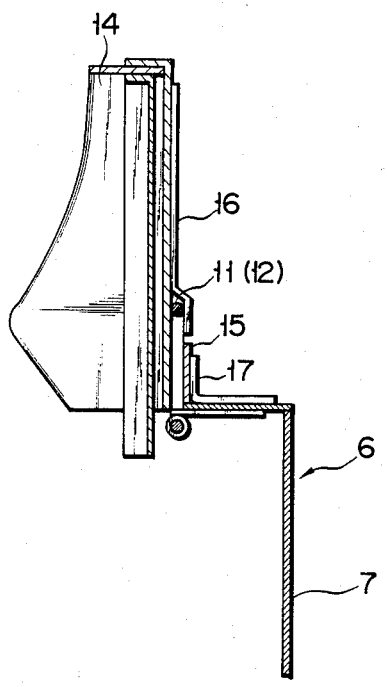
FIG. 8 is a sectional view of the urinal mounted on the shielding unit.
Figure 9:
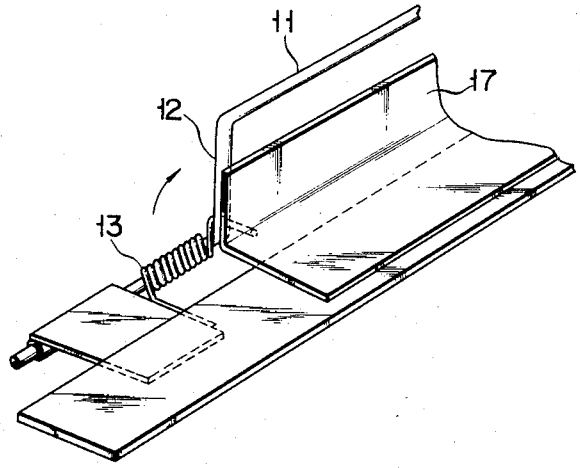
FIG. 9 is a perspective view of a mechanism for urging the shielding unit in an upright direction.

As shown in FIGS. 7 and 9, a mounting member 12 made of steel wire having a connecting portion 11 of substantially U-shape is laterally provided at one upper end of the body 7 of the bed frame 1 in such a manner that both ends are pivotally supported. Torsion coil springs 13 which urge the mounting member 12 in a clockwise direction, as designated by an arrow in FIG. 9, are respectively provided at both ends of the mounting member 12. A shielding unit 14 is detachably engaged to the connecting portion 11 of the mounting member 12. In other words, on the back surface of the shielding unit 14 are provided a first connecting member 15 which is bent in a substantially U-shape along the lateral direction of the shielding unit 14, and a second connecting member 16 which is bent in a crank shape at one end and is perpendicular to the first connecting member 15. The connecting portion 11 is inserted into a gap formed between the first connecting member 15 and the back surface of the shielding unit 14, and one end of the second connecting member 16 is connected to the portion projected from the gap, thereby detachably mounting the shielding unit 14 on the mounting member 12 (see FIG. 8). A holding plate 17 is provided substantially parallel to the mounting plate 12 at the top end of the body 7, and the shielding plate 14 is held at the top end of the body 7 against the urging force of the torsion coil spring 13 by the holding plate 17 in the substantially vertical state. The shielding plate 14 is normally held in the state as shown in FIG. 2 in contact with the lower surface of the bed frame 1.

Figure 4:
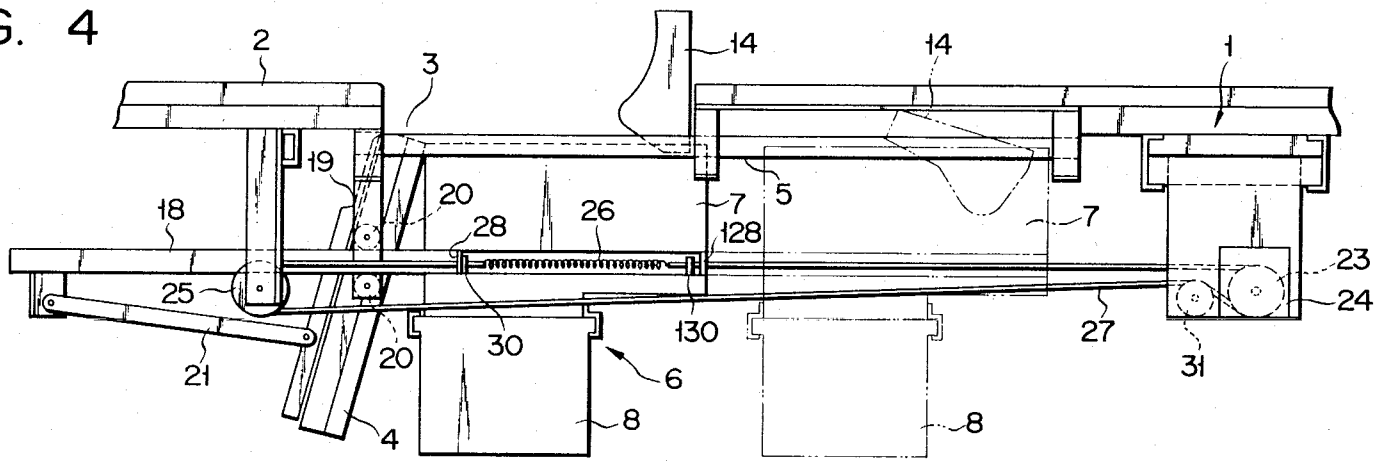
FIG. 4 is a side view of the bed apparatus in the state in which the urinal is moved to the position facing an opening.

As seen from FIG. 5, a guide frame 18 of substantially U-shape is secured at one end of both sides of the body 7 of the urinal 6 along the longitudinal direction of the bed frame 1. The other ends of both sides of the guide frame 18 are, as shown in FIG. 2, slidably supported by a pair of rollers 20. These rollers 20 are rotatably provided in a vertical direction on the inner surfaces of a pair of supporting rods 19, one of which is shown, depending, at an interval corresponding to the width of the guide frame 18, from the lower surface of the bed frame 1. At the intermediate portion of the guide frame 18 a connecting rod 21 is pivotally secured to the guide frame at one end and to the lower surface of the cover 4 at the other end. The cover 4 is held by the connecting rod 21 in the state of closing the opening 3 when the urinal 6 is displaced from the opening 3 as shown in FIG. 2. When the urinal 6 is driven together with the guide frame 18 in the direction of the opening 3 as will be described later, the connecting rod 21 is, as shown in FIG. 4, moved to pivot the cover 4 to the lower side of the bed frame 1, thereby opening the opening 3. The contacting state of the shielding plate 14 with the bed frame 1 can be released at this time. Accordingly, the shielding unit 14 is erected in a substantially vertical direction and is projected from the opening 3.

Figure 3:
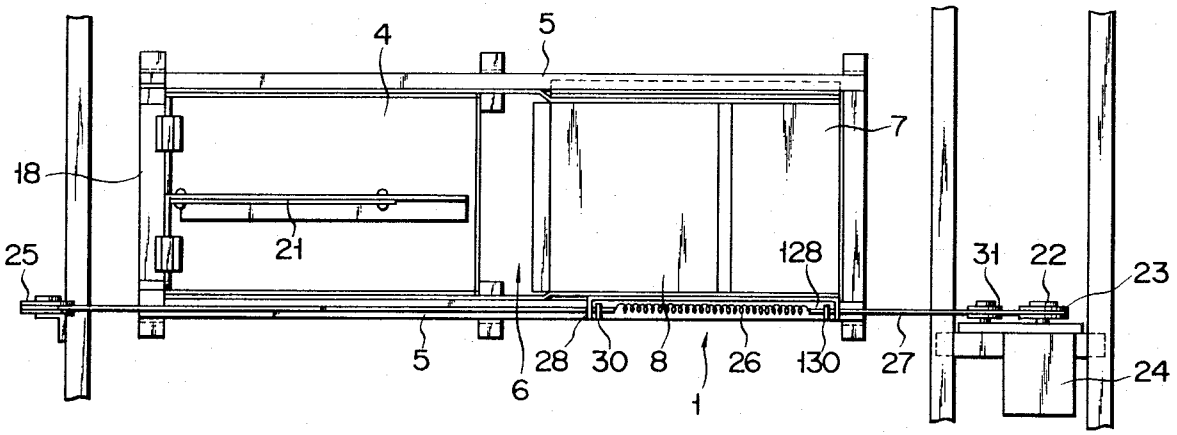
FIG. 3 is a bottom plan view of the bed frame.

As shown in FIGS. 2 to 4, a motor 24 having an output shaft 22 and a first pulley 23 is provided at one longitudinal end on the lower surface of the bed frame 1, and a second pulley 25 is rotatably provided at the other longitudinal end. A wire 27 which is connected by a tension spring 26 at both ends is engaged between the first pulley 23 and the second pulley 25. Both ends of the wire 27 are respectively inserted into notches 29 formed at a pair of first and second tong pieces 28 and 128, which are, as seen from FIG. 5, mounted in space at one side of the guide frame 18 along the longitudinal direction of the guide frame 18. Stops 30 and 130 which are respectively larger than the notches 29 are fixedly secured to both ends of the wire 27. A third pulley 31 for increasing the contacting length of the wire 27 with the first pulley 23 is rotatably provided in the vicinity of the first pulley 23. The output shaft 22 of the motor 24 can be reversibly rotated by the operation of a switch provided in a controller (not shown).

When the urinal 6 is utilized in the bed apparatus thus constructed, the output shaft 22 of the motor 24 is rotated, for example, by the operation of the switch in the controller, and the wire 27 is moved in a direction as designated by an arrow in FIG. 2. Then, the stop 30 contacts the first tong piece 28 projected from the guide frame 18. Thus, the guide frame 18 moves with the movement of the wire 27, and the urinal 6 is moved together with the guide frame 18 toward the opening 3. When the guide frame 18 is thus moved, the connecting rod 21 which is pivotally secured to the guide frame 18 and the cover 4 is rotated, as shown in FIG. 4, and the cover 4 is then rotated toward the lower side of the bed frame 1. When the cover 4 is fully opened, the urinal 6 is positioned in a position facing the opening 3, the shielding unit 14 provided at the top end of the urinal 6 is projected by the biasing force of the torsion coil spring 13 from the opening 3 and is erected in a substantially vertical direction. When the shielding unit 4 is thus erected in this manner, a limit switch (not shown) is operated to stop the motor 24.

When the urinal 6 is then used, the output shaft 22 of the motor 24 is rotated to move the wire 27 in the opposite direction. Then, the other stop 130 contacts the second tong piece 128, and the urinal 6 is moved together with the guide frame 18 in a direction away from the opening 3. Thereafter, the shielding unit 14 is moved toward the lower side of the bed frame 1. Further, the cover 4 is rotated by the connecting rod 21 to close the opening 3. When the urinal 6 is returned to its initial position, the motor 24 is stopped by a limit switch (not shown).

According to the structure of the bed apparatus thus constructed, both ends of the wire 27 are connected through the tension spring 26, and the stops 30 and 130 which respectively contact the first and second tong pieces 28 and 128 projected from the guide frame 18 are provided at both ends of the wire 27. Therefore, either of the stops 30 or 130 contacts the first tong piece 28 or the second tong piece 128 in response to the driving direction of the urinal 6, thereby transmitting the driving force of the wire 27 to the urinal 6. Thus, the tension of the wire 27 cannot be applied to the tension spring 26, resulting in no elongation of the spring 26. When the wire 27 is elongated due to long term use, the spring 26 is contracted in response to the elongation of the wire 27. Therefore, no slippage occurs due to the slack of the wire 27. In other words, the urinal 6 is not only driven by the wire 27, but the elongation of the wire 27 can be absorbed by the spring 26, even if the wire 27 is elongated due to long term use, thereby effectively driving the urinal 6.

The present invention is not limited to the embodiment described above. Various other changes and modifications may be made within the spirit and scope of the invention. For example, in the embodiment described above, the tong pieces which engage the stops of the wire might not be provided on the guide frame but instead provided on the body of the urinal. It is essential only that the urinal can move in conjunction with the movement of the wire.

What is claimed is:

1. A bed apparatus with a urinal and an integral drive mechanism for moving the urinal between a closed, storage configuration and an open, use configuration, comprising:

a bed frame placed with a cushion unit thereon, a cover pivotally provided at an opening formed in the cushion unit, a urinal slidably held along the longitudinal direction of said bed frame beneath said cushion and mounted by means of a guide frame along the sliding direction thereof, a shielding unit pivotally disposed at a top end of the urinal, normally held, in said closed configuration, in the horizontal state underneath the cushion unit, displaced from said opening, and means for urging said shielding unit toward a vertical state, and a drive mechanism including:

a drive means fixed on one of said bed frame and said urinal, a wire, adapted to be driven by said drive means, having two ends, and interconnecting said drive means and said urinal, so as to enable relative movement thereof, stops disposed at respective ends of said wire, a pair of tong pieces projecting from one of the guide frame and the urinal and adapted to engage said stops at the ends of said wire, a tension spring disposed between the tong pieces, connected to the ends of said wire and adapted to take up any slack in said wire, and a connecting rod connected at one end thereof to said cover and at the other end thereof to the guide frame and adapted, in response to movement of said guide frame, to pivot said cover toward the lower side of the bed frame when the urinal faces the opening, thereby uncovering the urinal for use by a person resting on said bed.

2. The bed apparatus of claim 1, wherein said urinal comprises a rectangular upper section and a detachable lower tank section.

3. The bed apparatus of claim 2, wherein said tank is slidably mounted on rails depending from the upper section of said urinal.

4. The bed apparatus of claim 1, further comprising a pair of flanges, one projecting laterally from each side of the top of said urinal, and a pair of parallel rails, fixed to the underside of said bed along the longitudinal axis thereof, and adapted to slidably support said urinal in close proximity to the underside of said cushion.

5. The bed apparatus of claim 1, wherein said drive means comprises a motor mounted on said bed frame and a pulley at each longitudinal end of said bed frame, at least one of said pulleys being driven by said motor.

6. The bed apparatus of claim 5, wherein said wire is wound, under the tension of said spring, around said pulleys.

7. The bed apparatus of claim 6, further comprising an auxiliary pulley mounted on said bed frame between said end pulleys at a position displaced, by a distance less than the radius of said driven end pulley, from a line connecting the centers of said pulleys, so as to urge said wire into contact with said driven pulley around more than one-half of its circumference.

8. The bed apparatus of claim 1, wherein said means for urging said shielding unit comprises a torsion spring.

9. The bed apparatus of claim 8, further comprising a holding plate adapted to limit said shielding unit in the substantially vertical state against the urging of said torsion spring when said apparatus is in the use configuration.

10. The bed apparatus of claim 1, further comprising a means for securing said shielding unit in the substantially vertical state when said apparatus is in the use configuration.

11. The bed apparatus of claim 1, wherein said opening has two edges parallel to the latex axis of said bed, said cover is pivoted at the lateral opening edge remote from the location of said urinal in the storage configuration, and said guide frame, cover and urinal are dimensioned such that the unpivoted lateral edge of said cover passes through the plane of said guide frame as said urinal is moved longitudinally beneath said opening.

12. The bed apparatus of claim 11, wherein said shielding unit is pivoted at the side of said urinal remote from the pivot of said cover, so as to bear against the edge of said opening and automatically fold back under said cushion as said urinal is moved from beneath said opening back to a storage position under said cushion.

* * * * *